United States Patent [19]

Steeves

[11] Patent Number: 4,884,618

[45] Date of Patent: Dec. 5, 1989

[54] ROLLER BLIND MOUNTING AND ROLLING SYSTEM

[76] Inventor: Christopher Steeves, 14 Duncan St., Toronto, Ontario M5H 3G8, Canada

[21] Appl. No.: 228,498

[22] Filed: Aug. 5, 1988

[51] Int. Cl.[4] ..... A47G 5/02

[52] U.S. Cl. ..... 160/321; 160/323.1

[58] Field of Search ..... 160/321, 322, 318, 313, 160/296, 299, 305, 307, 319, 23.1, 323.1, 325, 326; 242/68.5

[56] References Cited

U.S. PATENT DOCUMENTS

| | | | |
|---|---|---|---|
| 1,605,111 | 11/1926 | Holt et al. | 160/313 |
| 2,109,112 | 2/1938 | Hanson | 160/307 X |
| 3,854,517 | 12/1974 | Nakamura | 160/321 X |
| 4,379,481 | 4/1983 | Juner et al. | 160/310 |
| 4,712,599 | 12/1987 | Komaki | 160/321 X |

*Primary Examiner*—Blair M. Johnson

[57] ABSTRACT

The present invention provides a roller blind construction comprising a flexible blind which is windable for lowering and raising the blind. The blind has a downward weighting which increases as it is lowered and the construction further includes a conuterbalancing coil spring which products an upward pull increasing in direct relation to and neutralizing the downward weighting without lifting the blind.

6 Claims, 5 Drawing Sheets

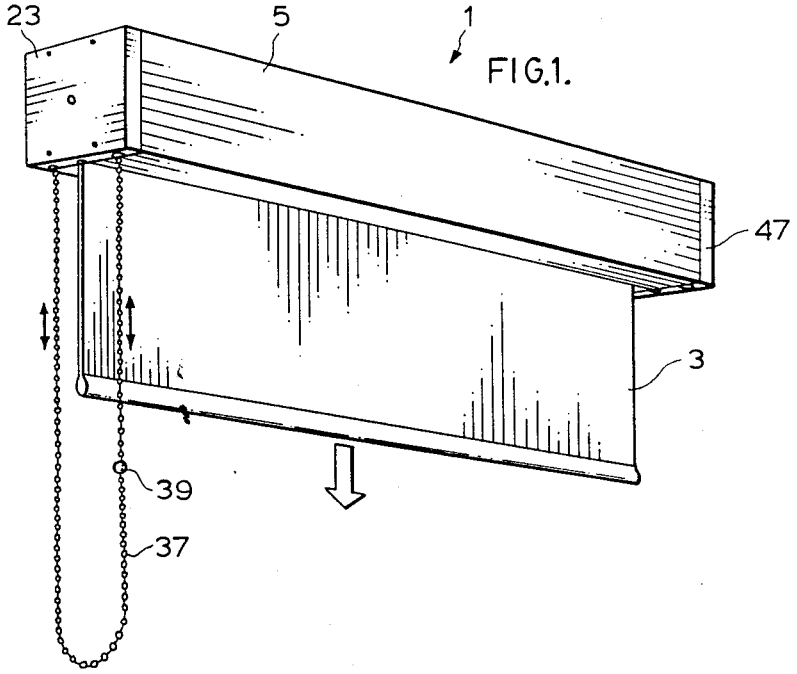
FIG.1.
FIG.2.
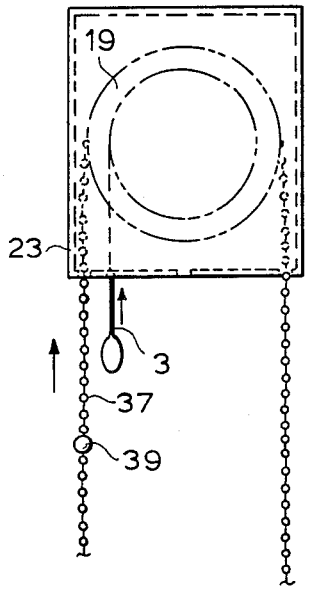
FIG.3.
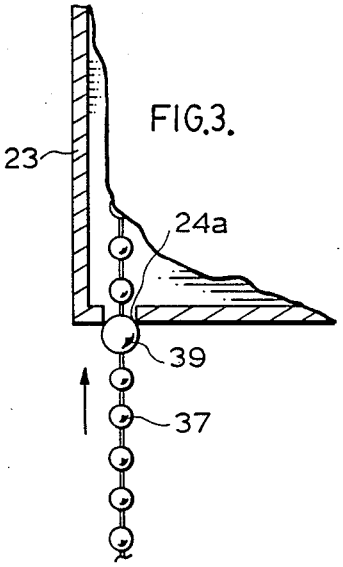

ROLLER BLIND MOUNTING AND ROLLING SYSTEM

FIELD OF THE INVENTION

The present invention relates to a roller blind and in particular a spring assembly for controlling weighting of the roller blind.

BACKGROUND OF THE INVENTION

Roller blinds are very popular for industrial use. However, one of the drawbacks of a conventional industrial roller blind is that the blind, being of substantial size, is often very heavy to rewind from a lowered position.

In typical home style smaller roller blinds, a coil spring is used as an automatic rewind for the blind. A lock is provided to hold the coil spring in different tensioning positions. The spring tension is substantially greater than the weight of the blind so that as soon as the lock is released the coil spring pulls the blind upwardly. This type of spring actuated return is fickle in that if the lock should release prematurely, the blind virtually flies upwardly and can often unwind on its mounting shaft. This type of an arrangement is not suitable for a much heavier industrial blind.

A type of industrial blind control that is available through General Clutch Corporation is one which uses a spring clutch tightening as the blind is unwound and loosening as the blind is lifted. However, there is no spring assist in the lifting of the blind which is accomplished by hand through a chain drive. This arrangement suffers from the drawback noted above, i.e. the awkwardness of handling the weight of a large industrial blind.

SUMMARY OF THE PRESENT INVENTION

The present invention provides a roller blind construction which is not subject to uncontrolled blind rewinding as found in small home blinds but which does include a spring assist not found in standard awkward to use industrial blinds. More particularly, the roller blind of the present invention comprises a flexible blind windable on a rotatable blind mount for lowering and raising the blind. The blind has a downward weighting which increases as it is lowered, however the blind construction further includes a counterbalancing coil spring which produces an upward pull in direct relation to and neutralizing that downwward weighting without lifting the blind.

As a result of the counterbalancing, although the blind is not actually lifted by the spring, it is essentially weightless easily enabling lifting of the blind by hand.

BRIEF DESCRIPTION OF THE DRAWINGS

The above as well as other advantages and features of the present inention will be described in greater detail according to the preferred embodiments of the present invention in which;

FIG. 1 is a perspective view of a roller blind construction according to a preferred embodiment of the present invention.

FIG. 2 is a section through the chain drive end of the roller blind of FIG. 1.

FIG. 3 is an enlarged view of the chain and end cap from the roller blind of FIGS. 1 and 2.

DETAILED DESCRIPTION ACCORDING TO THE PREFERRED EMBODIMENTS OF THE PRESENT INVENTION

FIG. 1 shows a roller blind construction, generally indicated at 1. This roller blind construction includes a flexible blind 3, which winds and unwinds into and out of a housing 5 containing the mounting components for blind member 3.

Figure 5:
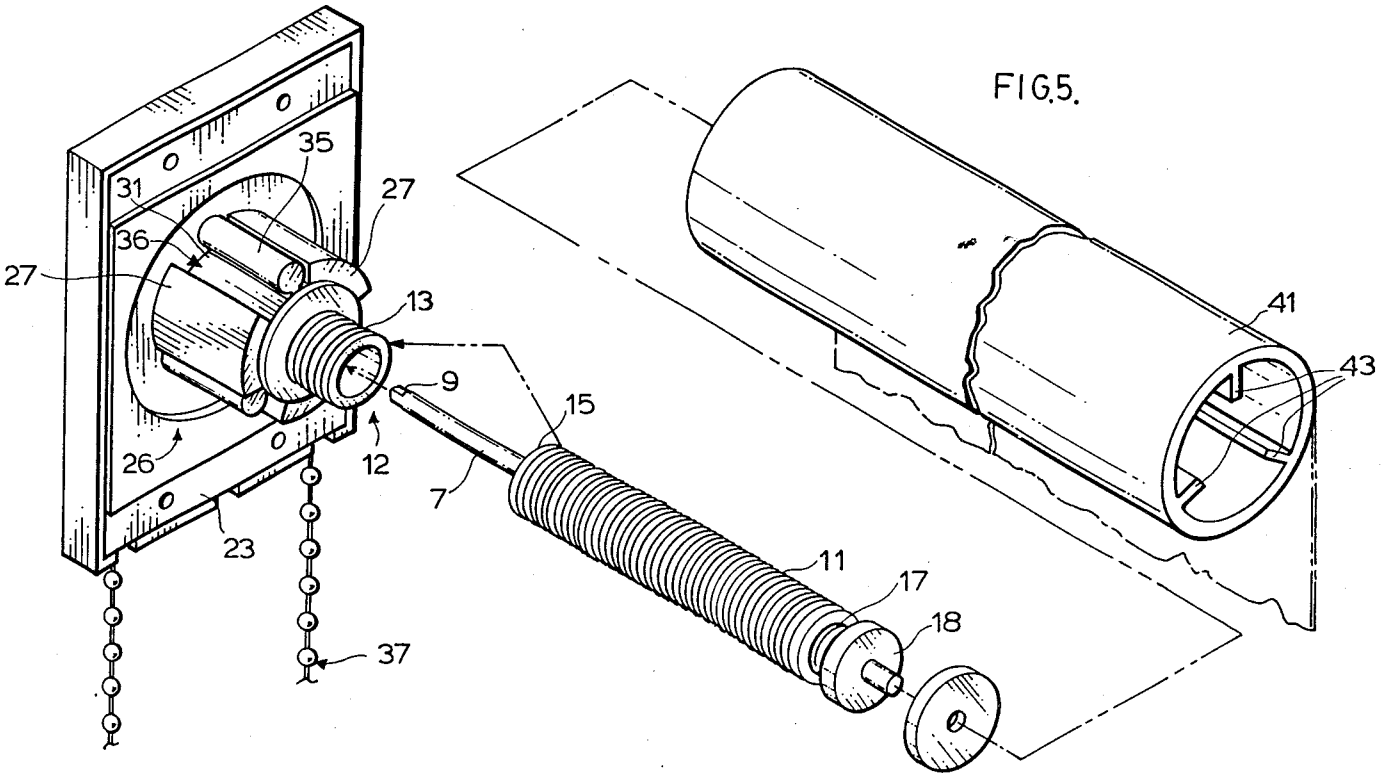
FIG. 5 is a further exploded perspective view showing assembly of the blind components.

More particularly and referring to FIG. 5, blind 3 is windably mounted on a roll-like blind mount 41 fitted over a supporting non-rotating shaft 7. Also fitted over shaft 7 interiorly of the blind mount is a coil spring 11.

Figure 4:
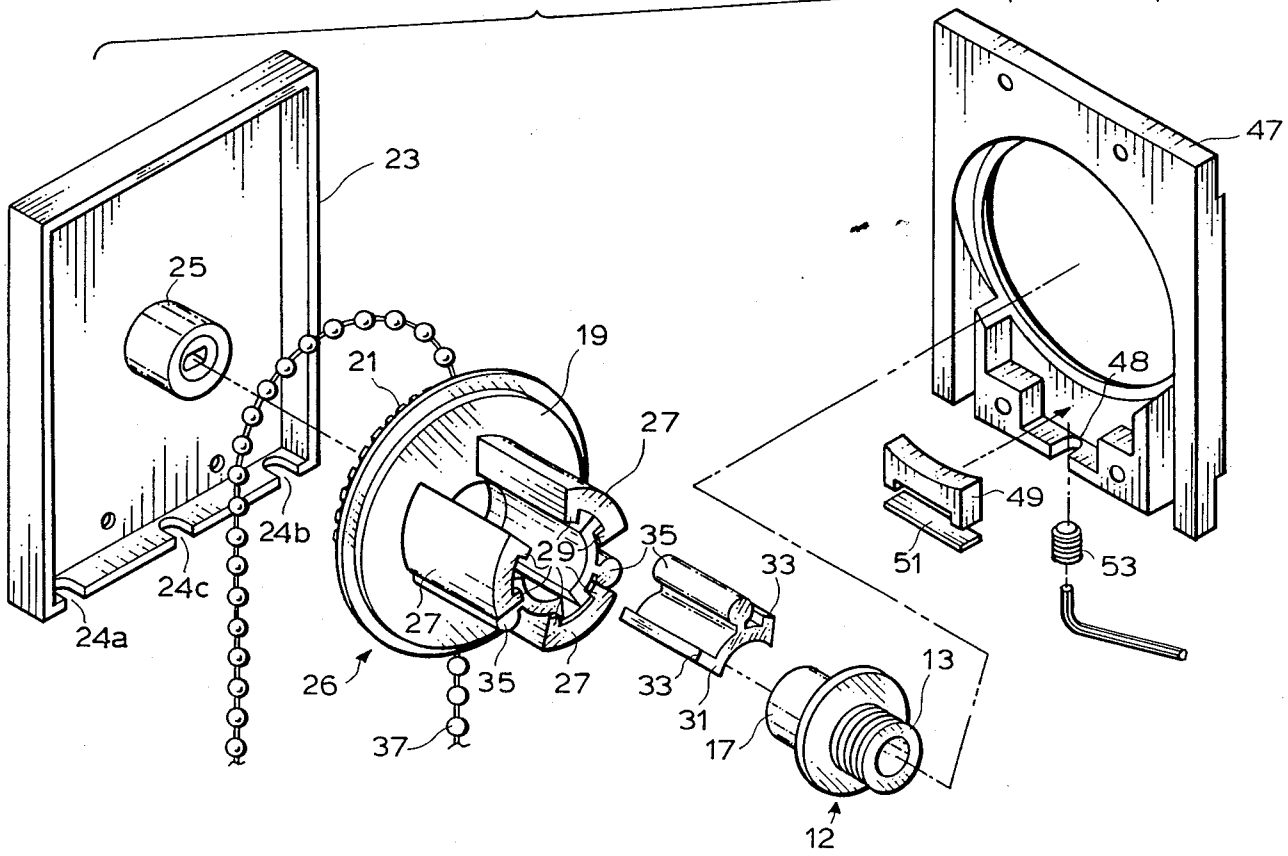
FIG. 4 is an exploded perspective view showing the end assemblies at opposite ends of the roller blind of FIG. 1.

FIGS. 4 and 5 show an end cap 23 for housing 5 and a blind movement and spring control assembly 26, including a spring connector generally indicated at 12. This spring connector has a threaded end 13 onto which end 15 of spring 11 threads and a mounting end 17, seen only in FIG. 4, which is rotatably coupled with assembly 26. This control assembly comprises a main disk 19 fitted over the cylindrical inwardly projecting portion 25 to the interior of cap 23 and having a geared surface 21 for engaging chain 37. Mounted to the inner surface of disk 19 are a series of mounting components 27 and 31. Each of the mounting components 27 includes a pair of inwardly projecting legs 29 while each of the mounting components 31 includes a pair of outwardly projecting legs 33 interlocking between legs 29 of adjacent mounting components 27 as seen in FIG. 4 of the drawings. Each of the mounting components31 further includes rubber-like shock absorbers 35.

The blind movement and spring control assembly 26 is rotated for the winding and unwinding of the blind and causes rotation of spring end 15 secured to spring connector 12 while the other end of the spring is secured against rotation as to be described later in detail. Therefore, one end of the spring rotates with the blind while the other end of the spring is fixed against rotation.

Blind mount 41 is provided with inwardly directed webs 43. These webs fit in the recesses between shock absorbers 35 of mounting components 31 and the side walls of mounting components 27. One of these recesses is indicated at 36 in FIG. 5. Therefore, by virtue of this interlocking of the webs of the blind mount with the assembly 26, the blind is wound and unwound by the blind movement and spring control assembly.

FIG. 4 shows a second end cap 47 fitted to the opposite end of housing 5 from cap 23. This end cap includes a large central opening for rotatably receiving the end of the blind mount and is provided with a brake arrangement for adjusting the ease with which the blind mount rotates within the housing. This brake arrangement comprises a brake pad 49 having an inner surface contoured to fit to the blind mount and an outer surface provided with a leaf spring 51. Cap 47 includes an opening 48 for receiving a set screw 53 which rides up against leaf spring 51. The setting of screw 53 determines the amount of pressure that the brake pad through leaf spring 51 applies on the outer surface of the blind mount.

Figure 8:
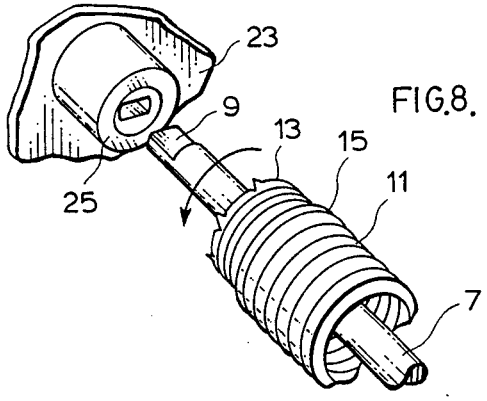
FIG. 8 is an enlarged perspective view of the left end region of the shaft mount from FIG. 7.
Figure 9:
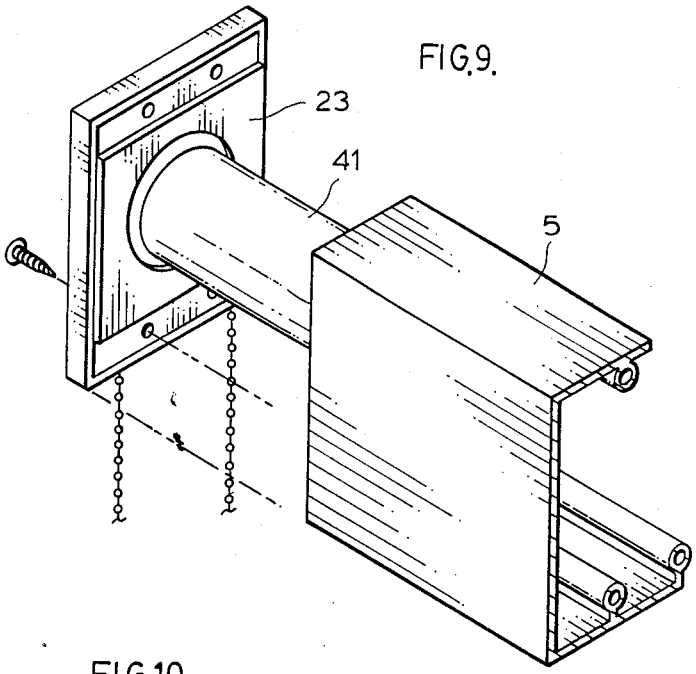
FIG. 9 is a partially exploded perspective view of the left end assembly of FIG. 1.

FIG. 8 shows the actual mounting of shaft 7 within the overall assembly. Here it will be seen that the shaft includes a flattened end 9 which fits into a corresponding opening of the end cap protrusion 25. This fitting locks the shaft against rotation and since the shaft is locked against rotation so is end 17 of the spring where it is attached through spring connector 18 to the shaft. The other end 15 of the spring is, as described above, rotatable with winding and unwinding of the blind through spring connector 12 rotatably coupled to disk 19. Therefore, the spring is also wound and unwound by lowering and raising the blind respectively to vary the springs upward pull according to the degree to which the blind is unwound. However, at the same time the downward weighting of the blind varies according to the degree to which the blind is unwound.

The lowering and raising of the blind is done by hand through chain 37. This chain fits upwardly through end cap 23 at the two bottom openings **24*a* and 24*b* seen in FIG. 4 of the drawings and wraps around gear surface 21 on disk 19. Chain 37 includes one enlarged bead 39 which acts as an end stop in that it will not fit up through opening 24*a* in cap 23** and therefore determines the maximum position to which the blind can be unwound.

The operation of the overall system is as follows. With the blind totally raised, spring 11 is at an initial preferably neutral, coil tension relative to the blind mount and the roller blind. However, as the blind is unwound the coil spring, being secured at one end to rotate and being fixed at its other end against rotation is wound up relative to the neutral setting as the blind is unwound producing an upward lift on the blind. However, at the same time, the blind as it is unwound increases in downward weighting producing a downward pull in the opposite direction to the upward lift of the spring. For best utilization of the system, the spring tension is set such that it just offsets the down weighting of the blind at all blind positions. Therefore, although the spring provides a counterbalance, it does not physically lift the blind. This is to be contrasted to the home use blinds earlier described that require a lock to hold the spring from automatically lifting the blind.

Figure 6:
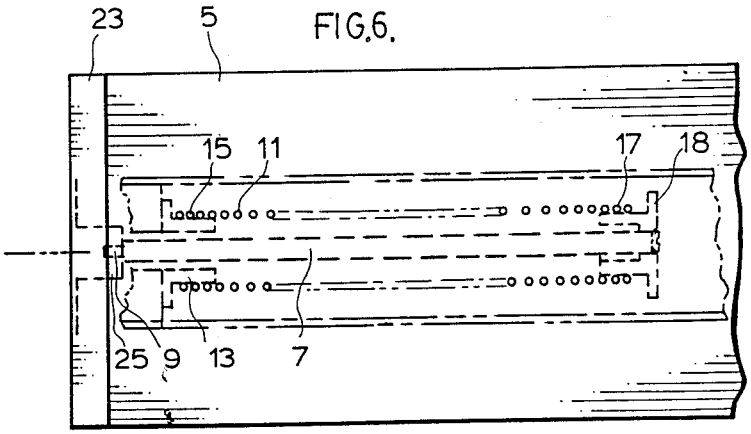
FIG. 6 is a sectional view looking from the front of the blind of FIG. 1.
Figure 7:
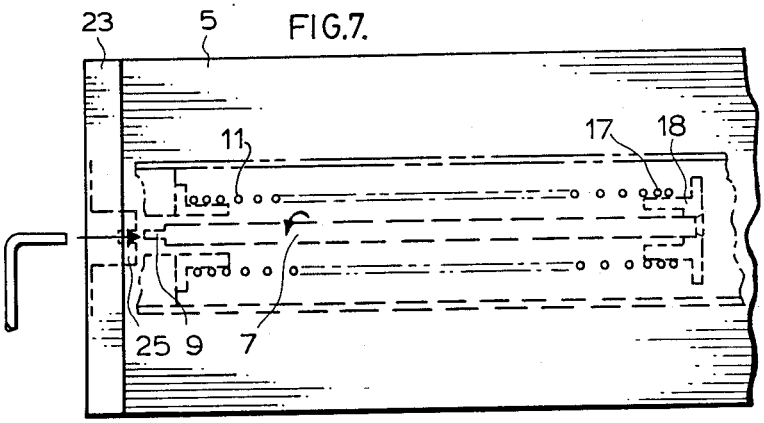
FIG. 7 is a view similar to FIG. 6 showing tension adjustment for the coil spring of the roller blind.

The tension of the spring is, as seen in FIGS. 6 through 8, easily adjusted at its initial setting to accomodate different blind weights. In FIG. 6, shaft end 9 through the spring loading on the shaft is forced to lock in extension 25 on the inner surface of end cap 23. However, as seen in FIG. 7, through the use of an appropriate tool, shaft end 9 is simply popped out of its engagement with extension 25 and the shaft is then rotated as shown to either decrease or increase the winding of the spring. This is again achieved as the result of the spring being connected at one end only to the shaft.

Figure 10:
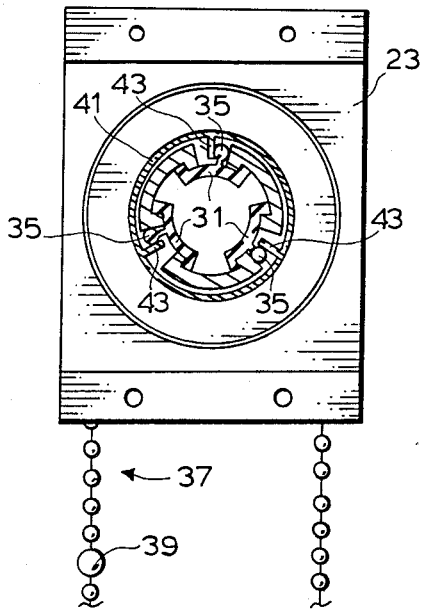
FIG. 10 is a sectional view through the assembled end cap of FIG. 9 showing position of the blind mount with the blind in a partially lowered position.
Figure 11:
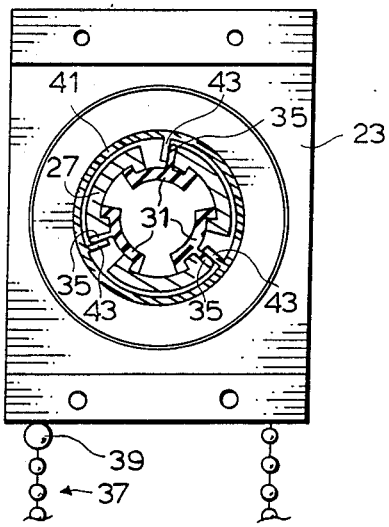
FIG. 11 is a view similar to FIG. 10 showing the blind mount with the blind in a fully lowered position.

Although safety components such as the spring tension and the brake are built into the blind, it is still further provided with a shock absorbing feature the components of which have been described above and the operation of which is described having reference to FIGS. 10 and 11 of the drawings. This shock absorber feature is provided to prevent breakage of the chain used to raise and lower the blind which is a common occurance in other presently available roller blinds. Here it should be noted that the chain control, using a large stop ball such as ball 39 in the chain is common to the industry and the breakage of the chain in prior art structures occurs as a result of impact of that ball with its stop guard when the blind moves abruptly to its lowermost setting. However, in the present application this impact is absorbed as shown in FIG. 11 of the drawings where although ball 39 comes up into contact with the bottom of the end cap, the roller-like blind mount 41 is allowed to continue to rotate very slightly by collapsing members 35 through blind mount webs 43 as seen in FIG. 11. This absorbs the shock or impact which would otherwise be placed on ball 39 used to stop the downward momentum of the blind. Note FIG. 10 shows the blind as it is being lowered but prior to ball 39 running up against the bottom of end cap 23.

A further unique feature of the present design can be seen in FIG. 1 of the drawings showing the two end caps 23 and 47. As will be further seen in FIG. 4 of the drawings, end cap 23 includes a center slot **24*c* actually fitting around the end of the blind. End cap 47** has a similar construction. Accordingly, the end caps fit to either side of the blind and act as a light block for preventing outside light from passing around the end of the blind.

Although various preferred embodiments of the invention have been described in detail, it will be appreciated that variations may be made without departing from the spirit of the invention or the scope of the appended claims.

The embodiments of the invention in which an exclusive property or privilege is claimed are defined as follows:

1. A roller blind assembly comprising a flexible blind windable on a rotatable blind mount for lowering and raising said blind, said blind having a downward weighting which increases as said blind is lowered with said assembly further including a counter-balancing coil spring acting on said blind mount to produce an upward pull in direct relation to and neutralizing such downward weighting without lifting of said blind, said counter-balancing spring being sleeved on a shaft interiorly of said blind mount and said spring having a first end coupled with said blind mount and a second end coupled with said shaft, said shaft having a blind operating position in which said shaft is fixed against rotation and said blind mount rotates around said shaft to cause winding and unwinding of said spring and a spring adjustment position in which said shaft and said second end of said spring are rotated and said first end of said spring is held against rotation on said blind mount to adjust tension on said spring according to weight of said blind, said spring providing an axial bias on said shaft to move said shaft to said blind operating position and said shaft being movable against said axis basis to move said shaft to said adjustment position.

2. An arrangement as claimed in claim 1, having first and second end caps at opposite ends of said blind mount, said first end cap including a blind movement and spring control assembly.

3. An assembly as claimed in claim 2, wherein sid blind movement and spring control assembly comprises a chain operated blind mount rotating member on which said first end of said spring is mounted to couple said first end of said spring with said blind mount, said blind mount including inwardly directed webs for engaging said rotating member, said rotating member having recesses in which said webs are fitted and said recesses being provided with resilient shock absorbers which are collapsed by said webs for absorbing shock in said assembly with lowering of said blind.

4. An assembly as claimed in claim 1, including an adjustable brake for controlling rotation of said blind mount.

5. An arrangement as claimed in claim 4, wherein said adjustable brake comprises a leaf spring and set screw combination for applying pressure on said blind mount.

6. An arrangement as claimed in claim 2, wherein said first end cap is provided with a shaft receiving slot with said shaft having a flattened end forced into said slot by said spring bias to prevent rotation of said shaft, said shaft end being releasable from said slot for moving said shaft to said spring adjustment position.

* * * * *